United States Patent [19]

Boaz

[11] 4,141,011

[45] Feb. 20, 1979

[54] RADIO ANTENNA FOR AUTOMOBILE WINDSHIELD

[75] Inventor: Premakaran T. Boaz, Southgate, Mich.

[73] Assignee: Ford Motor Company, Dearborn, Mich.

[21] Appl. No.: 875,272

[22] Filed: Feb. 6, 1978

[51] Int. Cl.[2] ..... H01Q 1/32

[52] U.S. Cl. ..... 343/713

[58] Field of Search ..... 343/711, 712, 713, 720

[56] References Cited

U.S. PATENT DOCUMENTS 4,086,595 6/1978 Cherenko et al. ..... 343/713

*Primary Examiner*—Eli Lieberman

*Attorney, Agent, or Firm*—William E. Johnson; Keith L. Zerschling

[57] ABSTRACT

A radio antenna is disclosed. The antenna is formed in part by an antenna pattern bonded to an inner surface of a glass substrate. The antenna pattern is made of an electrically conductive material. The antenna pattern has an antenna portion and a terminal portion. An electrical connection is made to the terminal portion. The electrical connection provides a seal for the connection which eliminates dust and moisture attack thereon. The electrical connection is formed in a simple and efficient operation.

5 Claims, 3 Drawing Figures

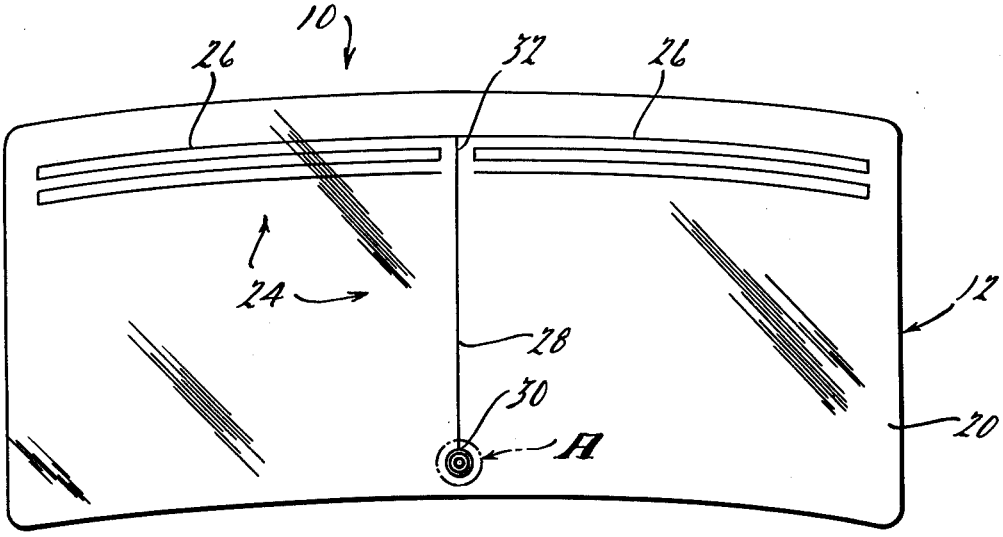
FIG. 1.
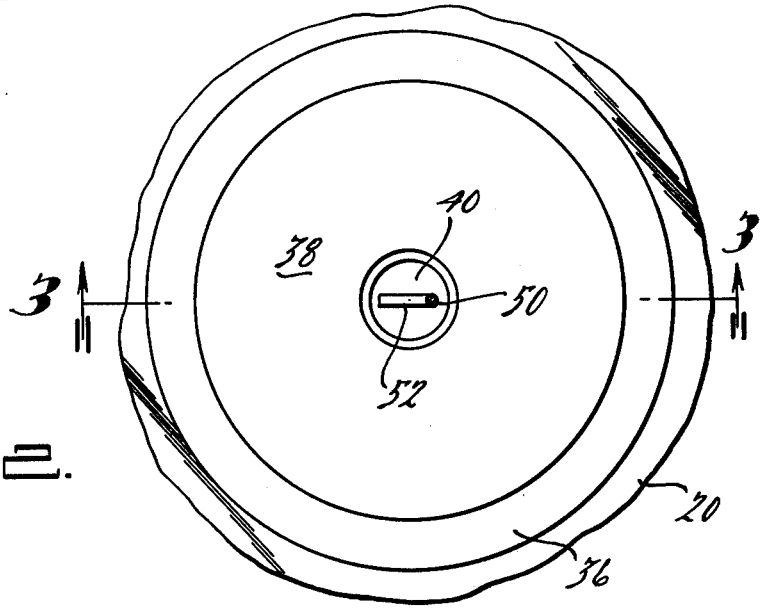
FIG. 2.
FIG. 3.
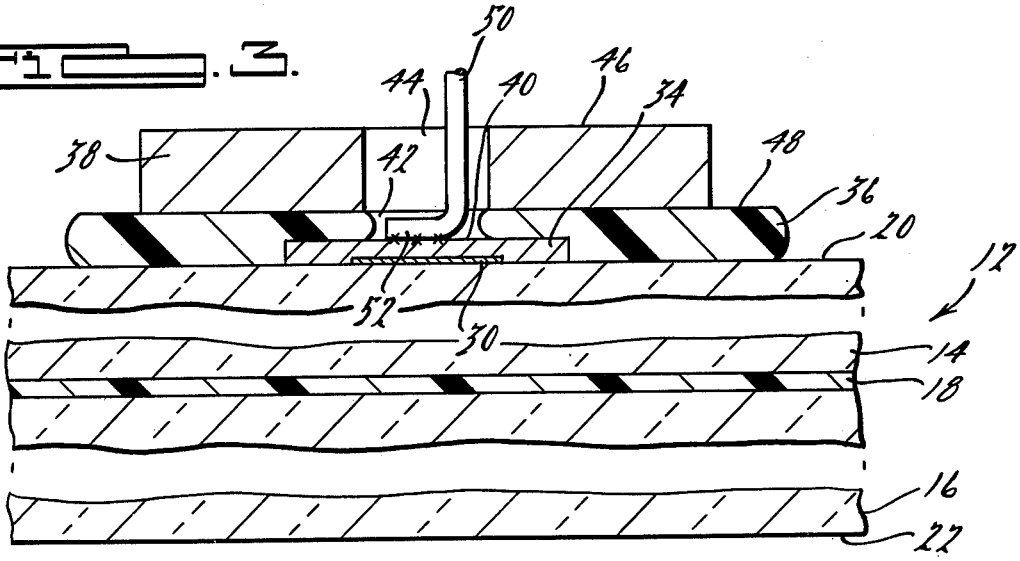

RADIO ANTENNA FOR AUTOMOBILE WINDSHIELD

BACKGROUND OF THE INVENTION AND PRIOR ART STATEMENT

A novelty study conducted on the subject matter of this invention resulted in the citation of the following U.S. Pat. Nos. 3,414,902; 3,818,489; and 3,866,232. The three mentioned patents all show radio antenna systems built into a laminated windshield. All three systems include wire antenna elements which are included in the laminating interlayer between the two pieces of glass which form the windshield when bonded together by the laminating interlayer. These devices are distinctly different from the device of this application in that the device presently disclosed does not use wire elements as the antenna element and the antenna element is not located in the laminating interlayer between the two pieces of laminated glass.

The device of this invention is a radio antenna which may be placed on a surface of a windshield, preferably the surface of the windshield which faces the interior of a vehicle. The device of this invention also provides a relatively simple and effective way of connecting the antenna pattern on the windshield to a terminal so that the antenna may be electrically associated with the radio of the vehicle.

It is a principal object of this invention to provide a radio antenna for a vehicle which is simple and efficient to construct and is made from easily assembled components.

SUMMARY OF THE INVENTION

This invention is directed to a radio antenna and, more particularly, to a radio antenna formed on a glass substrate, the glass substrate being intended for use as a closure member for a vehicle. For example, the radio antenna may be placed on a surface of the vehicle's windshield which faces into the interior of the vehicle.

In accordance with the teachings of this invention, an antenna pattern of electrically conductive material having an antenna portion and a terminal portion is bonded to an inner surface of a glass substrate which also has an outer surface. A conductive metal plate having dimensions to define its surface area and perimeter covers and is in electrically conductive relationship with at least a portion of the terminal portion of the antenna pattern.

A plastic sealing material is in the form of a sheet of material having dimensions to define its surface area and perimeter greater than the dimensions of the conductive metal plate. This plastic sealing material overlies and is in bonding contact with both the conductive metal plate and a portion of the inner surface of the glass substrate about the perimeter of the conductive metal plate. This covering and bonding contact of the mentioned elements seals the connection of the conductive metal plate and the covered portion of the terminal portion of the antenna pattern from dust and moisture attack. The plastic sealing material has a central opening therein which exposes a portion of an upper face of the conductive metal plate.

A metal member having dimensions to define its surface area generally not exceeding the surface area of the plastic sealing material overlies and is in bonding relationship to the plastic sealing material. This metal member also has an opening therein generally of the size of the opening in the plastic sealing material with the openings of the last two mentioned elements being aligned.

An electrical lead is bonded to the exposed portion of the upper face of the conductive metal plate. This electrical lead extends upwardly from its bonded position through the openings in the plastic sealing material and the metal member and defines the lead to which a connection may be made in order to connect the antenna pattern on the glass substrate to a radio in a vehicle.

In accordance with a preferred embodiment of this invention, the conductive metal plate is round and the plastic sealing material and metal member are ring shaped. In such a preferred case, the plastic sealing material can be formed of poly vinyl butryl.

BRIEF DESCRIPTION OF THE DRAWINGS

FIG. 1 is an elevational view of a radio antenna in accordance with the teachings of this invention formed on a glass substrate which, in a preferred embodiment, is to form a windshield of a motor vehicle.

FIG. 2 is an enlarged view of the area designated by the capital letter A in FIG. 1.

FIG. 3 is a cross sectional view taken along a line 3—3 of FIG. 2 showing in detail the elements forming the electrical connection for the radio antenna of this invention.

DESCRIPTION OF A PREFERRED EMBODIMENT

In FIG. 1 there is seen a preferred embodiment of a radio antenna in accordance with the teachings of this invention generally designated by the numeral 10. The radio antenna includes a glass substrate generally identified by the numeral 12. As best seen in FIG. 3, the glass substrate 12 is formed of a first glass sheet 14 and a second glass sheet 16 laminated together by a laminating inner layer 18. The formation of a laminated glass windshield is well known in the art. The finished glass windshield has an inner surface 20 and an outer surface 22.

As best seen in FIG. 1, a windshield antenna pattern generally designated by the numeral 24, is bonded to the inner surface 20 of the glass substrate 12. The antenna pattern has a pair of antenna portions 26-26 and a terminal portion 28. The antenna portions 26-26 are generally formed along the upper right and left hand sides of the glass substrate 12. The terminal portion 28 extends from a lower terminal end 30, best seen in FIG. 3, to its interconnection point at an upper end 32 thereof of the antenna portions 26-26.

The antenna pattern 24 is preferably formed from a silver ceramic paste which is electrically conductive. The silver ceramic paste, with suitable vehicle therein, can be silk screened onto the inner surface 20 of the glass substrate 12 in a silk screen printing operation. Thereafter, the material is heated in order to volatilize the vehicle of the silver ceramic paste to leave behind a consolidated mass of silver and ceramic which forms the antenna pattern 24. This silver ceramic residue is tightly bonded to the glass because of the heating operation. A silver ceramic paste is normally made up of 92% silver with 8% glass ceramic of a low melting type, such as lead boro-silicate.

FIG. 2 is an enlarged view of the area designated by the capital letter A in FIG. 1. FIG. 2, and FIG. 3, provide the best disclosure of the electrical connection made to the lower terminal end 30 of the antenna pattern 24. I will first describe the various individual elements forming this connection and thereafter describe how these elements are assembled.

In accordance with the teachings of the preferred embodiment, a conductive metal plate 34 of circular cross section formed of copper is placed over the lower terminal end 30 of the antenna pattern 24. In FIG. 3, the conductive metal plate 34 looks as if it has a notched out portion for receiving the lower terminal end 30 of the antenna pattern. In reality, this is not the case but in order to illustrate the materials in the drawings the thickness of the lower terminal end 30 is over emphasized.

On top of the conductive metal plate is located a ring shaped plastic sealing material 36. In accordance with the teachings of a preferred embodiment of this invention, the plastic sealing material is formed of poly vinyl butryl. This plastic sealing material has an outer diameter greater than the diameter of the conductive metal plate 34.

A metal member 38 is positioned on top of the plastic sealing material 36 as shown in FIGS. 2 and 3. This metal member is also of ring shape and in accordance with the teachings of a preferred embodiment, is formed from stainless steel.

In accordance with the teachings of this invention, the connection is made as follows. The conductive metal plate 34 is placed on the lower terminal end 30 of the antenna pattern 24 in an overlying condition. The ring shaped plastic sealing material 36 is then placed over the conductive metal plate 34 in such a relationship that a portion of a top surface 40 of the conductive metal plate 34 is exposed through an opening 42 in the plastic sealing material 36. The metal member 38 is then placed on top of the plastic sealing material 36. Once again, the top surface 40 of the conductive metal plate 34 is exposed through an opening 44 in the metal member 38. Forces are applied between an upper surface 46 of the metal member 38 and the outer surface 22 of the glass substrate 12. Simultaneously, with the application of pressure, dielectric heating is applied to the area of the terminal connection. The pressure applied is 200psi and the temperature to which the material is heated is 150° C. The application of heat and pressure causes several bonds to occur between the various elements. The conductive metal plate 34 is bonded in an electrically conductive relationship in terms of radio signals to the lower terminal end 30 of the antenna pattern 24. This bond occurs because of the intimate contact between the surfaces. Also, in the bonding operation, the plastic sealing material 36 becomes bonded to a portion of the top surface 40 of the metal member 34 and also to a portion of the inner surface 20 of the glass substrate 12 located about the conductive metal plate 34. This simultaneous bonding action to the two different surfaces provides a seal for the electrical connection between the conductive metal plate 34 and the lower terminal end 30 of the antenna pattern 24 which prohibits moisture and dust collecting or interfering with that connection. Also, during this bonding action, the metal member 38 is bonded to an upper surface 48 of the plastic sealing material 36.

The bonding operation is carried out for three seconds. After the operation is completed, the entire structure is permitted to cool back to room temperature. Once the entire assembly is cooled, an electrical lead 50 is bonded at a lower end 52 thereof to the top surface 40 of the metal member 38 to provide an electrical connection through the assembly to the lower terminal end 30 of the antenna pattern 24. The electrical lead 50 in turn may be connected to suitable circuitry associated with the radio so that the antenna pattern 24 may act as a source for receiving radio signals for the radio.

Many modifications of the radio antenna of this invention will be apparent to those skilled in the art in view of the teachings of this specification. It is intended that all such modifications falling within the scope of this invention be included within the scope of the appended claims.

I claim:

1. A radio antenna comprising:

a glass substrate having an inner surface and an outer surface;

an antenna pattern of electrically conductive material having an antenna portion and a terminal portion, both of said portions being inter-connected and bonded to said inner surface of said glass substrate;

a conductive metal plate having dimensions to define its surface area and perimeter, said conductive metal plate covering and being in electrically conductive relationship at least with a portion of said terminal portion of said antenna pattern;

a plastic sealing material in the form of a sheet of material having dimensions to define its surface area and perimeter greater than said dimensions of said conductive metal plate, said plastic sealing material also having an opening therein, said plastic sealing material overlying and being in bonding contact with both said conductive metal plate and a portion of said inner surface of said glass substrate about said perimeter of said conductive metal plate to seal the connection of said conductive metal plate and said covered portion of said terminal portion of said antenna pattern from dust and moisture attack, said opening in said plastic sealing member exposing a portion of an upper face of said conductive metal plate;

a metal member having dimensions to define its surface area generally not exceeding said surface area of said plastic sealing material and an opening therein generally of the size of said opening in said plastic sealing material, said metal member overlying and being in bonding relationship to said plastic sealing material, said opening of said last two mentioned elements being aligned; and an electrical lead bonded to said exposed portion of said upper face of said conductive metal plate, said electrical lead extending upwardly from its bonded position through said opening in said plastic sealing material and said metal member.

2. The radio antenna of claim 1, wherein:

said conductive metal plate is round, and wherein said plastic sealing material and said metal member are ring shaped.

3. The radio antenna of claim 2, wherein:

said plastic sealing material is formed of poly vinyl butryl.

4. A radio antenna comprising:

a glass substrate having an inner surface and an outer surface;

an antenna pattern of electrically conductive, silver ceramic material having an antenna portion and a terminal portion, both of said portions being interconnected and bonded to said inner surface of said glass substrate;

a round conductive metal plate having a diameter to define its surface area and perimeter, said conductive metal plate covering and being in electrically conductive relationship at least with a portion of said terminal portion of said antenna pattern;

a ring shaped plastic sealing material in the form of a sheet of material having an internal diameter and outside diameter to define its ring shaped surface area and perimeter greater than said perimeter of said conductive metal plate, said plastic sealing material overlying and being in bonding contact with both said conductive metal plate and a portion of said inner surface of said glass substrate about said perimeter of said conductive metal plate to seal the connection of said conductive metal plate and said covered portion of said terminal portion of said antenna pattern from dust and moisture attack, a central opening in said plastic sealing member defined by said internal diameter thereof exposing a portion of an upper face of said conductive metal plate;

a ring shaped metal member having an internal diameter slightly greater and an outside diameter slightly less than said internal and outside diameters of said plastic sealing member to define its surface area generally not exceeding said surface area of said plastic sealing material, said metal member overlying and being in bonding relationship to said plastic sealing material, said opening of said last two mentioned elements being aligned; and an electrical lead bonded to said exposed portion of said upper face of said conductive metal plate, said electrical lead extending upwardly from its bonded position through said opening in said plastic sealing material and said metal member.

5. The radio antenna of claim 4, wherein:

said plastic sealing material is formed of poly vinyl butryl.

* * * * *